United States Patent [19]

Neilsen

[11] 4,035,938

[45] July 19, 1977

[54] ROTARY CARD HOLDER

[75] Inventor: Hildaur L. Neilsen, Metuchen, N.J.

[73] Assignee: Rolodex Corporation, Secaucus, N.J.

[21] Appl. No.: 683,316

[22] Filed: May 5, 1976

[51] Int. Cl.[2] ..... G09F 11/02

[52] U.S. Cl. ..... 40/68.6; 211/58

[58] Field of Search ..... 40/68.6, 68, 74, 72, 40/73.2; 211/58; 312/328

[56] References Cited

U.S. PATENT DOCUMENTS

| | | | |
|---|---|---|---|
| 2,479,167 | 8/1949 | Karper | 211/58 |
| 2,731,966 | 1/1956 | Neilsen | 40/68.6 |
| 3,333,356 | 8/1967 | Bosland | 40/68 |
| 3,628,269 | 12/1971 | Dahl | 40/68.6 |
| 3,890,727 | 6/1975 | Rose | 40/68.6 |

*Primary Examiner*—John F. Pitrelli

*Attorney, Agent, or Firm*—Robert E. Burns; Emmanuel J. Lobato; Bruce L. Adams

[57] ABSTRACT

A rotary card holder has a rotor which carries a multiplicity of cards and is rotatably mounted between two upright supports of a case by means of a shaft which projects from the ends of the rotor and extends through the supports. The rotor is manually rotatable by means of knobs on the ends of the shaft. A V-shaped leaf spring in one of the knobs frictionally engages an annular boss on the case to retain the rotor in a position to which it is turned.

8 Claims, 6 Drawing Figures

ROTARY CARD HOLDER

FIELD OF INVENTION

The present invention relates to a rotary card holder having a rotor which is manually rotatable about a horizontal axis and carries a multiplicity of cards which are loosely mounted on the rotor and are sequentially presented to the view of a user as the rotor is manually rotated.

BACKGROUND OF INVENTION

Rotary card holders are widely used for name and address lists, telephone indices and many other uses where it is desired to provide for storage of information which can be readily and conveniently retrieved. A rotary card holder is highly useful and convenient since the rotor will hold a large number of cards which can be presented to the view of a user merely by rotating the rotor.

The cards are loosely mounted on the rotor by means of T-shaped notches in the inner edges of the cards which fit loosely over T-shaped ribs extending circumferentially of the rotor. When the rotor is rotated in a direction away from the user, the cards on the side of the rotor facing the user are sequentially lifted up until they assume an upright position whereupon they are pivoted rearwardly by gravity so as to be separated from following cards and thereby presented to the view of the user. Conversely, if the rotor is turned in a direction toward the user, the cards are sequentially lifted up on the rear side of the rotor and when they reach an upright position, pivot forwardly by gravity. By reason of the pivotal mounting of the cards on the rotor, there is a greater mass of cards on the side of the rotor on which the cards are being lifted. Hence, if the rotor is manually turned and then released, the action of gravity on the cards tends to turn the rotor in the reverse direction until equilibrium is reached. A number of devices have been previously proposed for retaining the rotor in the position to which it has been turned. However, such devices have not been found to be entirely satisfactory. Among objections to devices that have been heretofore proposed, are that they are expensive to manufacture and assemble, not entirely reliable or are noisy in operation.

SUMMARY OF INVENTION

It is an object of the present invention to provide a rotary card holder having improved means for holding the rotor in the position to which it has been turned by the user. Thus, the card which the user desires to view is kept in viewable position until the rotor is again turned to select another card.

In accordance with the present invention as will appear more fully from the following description, a spring mounted in a knob by which the rotor is manually turned, frictionally engages an annular boss provided on the case in which the rotor is rotatably mounted so as frictionally to retain the rotor in a position to which it has been turned by the user. In a preferred embodiment of the invention, the spring comprises a V-shaped leaf spring, the ends of which engage the inside of an annular flange on the knob while central portions are pressed by resiliency of the spring against the annular boss which is provided on an outer face of the case concentrically with a shaft by which the rotor is rotatably mounted in the case. The construction in accordance with the invention has the advantages of being simple and economical to produce and effective, reliable and silent in operation.

BRIEF DESCRIPTION OF DRAWINGS

The nature and advantages of the invention will be more fully understood from the following description of a preferred embodiment which is shown by way of example in the accompanying drawings, in which.

DESCRIPTION OF PREFERRED EMBODIMENT

Figure 2:
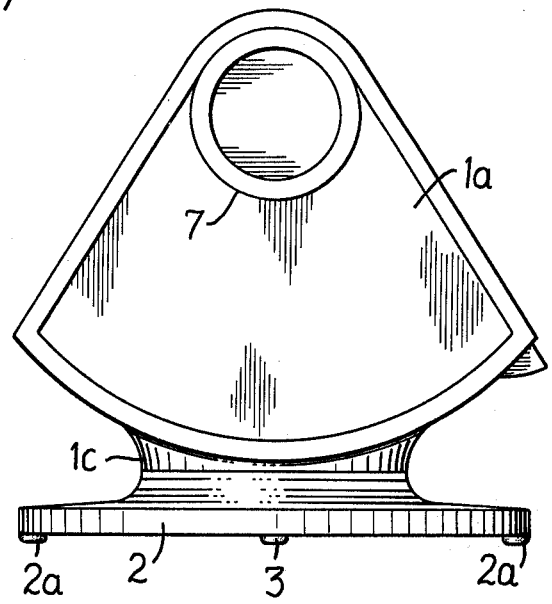
FIG. 2 is a side view looking at the left-hand side of the card holder as viewed in FIG. 1.
Figure 3:
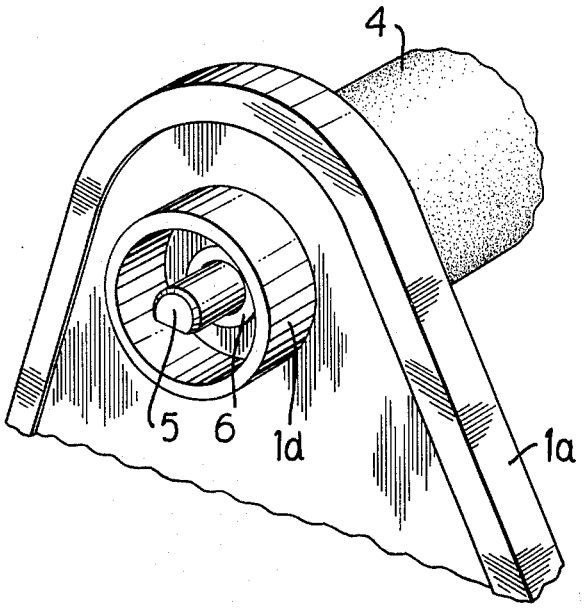
FIG. 3 is a fragmentary perspective view on a larger scale of the upper left-hand portion of the card holder shown in FIG. 1 but with the knob by which the rotor is rotatable removed.

The rotary card holder shown by way of example in the drawings comprises a frame or case 1 having at opposite sides upstanding support portions 1*a* and 1*b*. As viewed from the side of the card holder (FIG. 2) the support portions 1*a* and 1*b* are approximately sector shaped. The case has a circular base portion 1*c* and is pivotally mounted on a circular base 2 by means of a pivot shaft 3 concentric with the base 2 and the base portion 1*c* of the case. The base 2 is provided with foot portions 2*a* by means of which it is adapted to rest on a desk or other suitable supporting surface. By reason of the pivotal mounting of the case 1 on the base 2, the case can be turned to whatever position is most convenient for a user. The case 1 and base 2 are conveniently molded of suitable plastic material.

Figure 1:
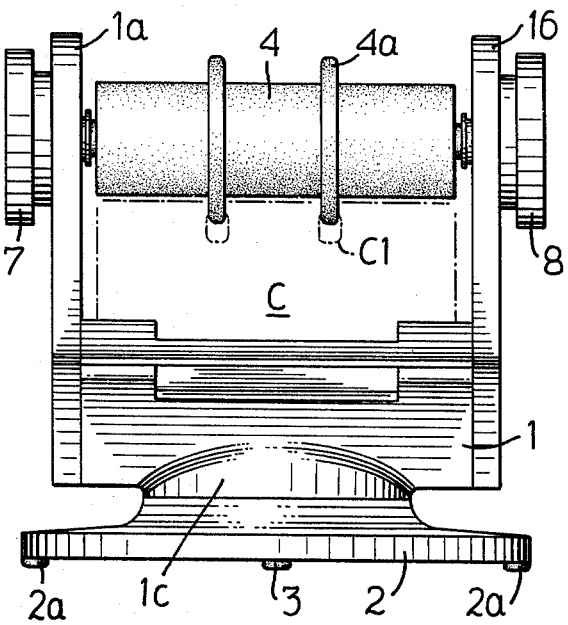
FIG. 1 is a front view of a card holder in accordance with the invention. A single card is shown in broken lines to illustrate how the cards are mounted on the rotor of the card holder.

A cylindrical rotor 4 extends between the two side supports 1*a* and 1*b* of the case 1 and is rotatably mounted in the case by a shaft 5 which projects from opposite ends of the rotor and extends through the side supports 1*a* and 1*b* in which it is rotatably supported by bearings 6. The rotor 4 is provided with circumferentially extending ribs 4*a* which are T-shaped in cross section to receive a multiplicity of cards C of which one is shown in broken lines in FIG. 1. The cards are provided at their inner edges with C-shaped notches C1 which are adapted to snap over the ribs 4*a* so as to mount the cards on the rotor 4. The notches C1 are of sufficient depth to permit a limited amount of pivoting of the cards relative to the rotor. In practice, a large number of cards are mounted on the rotor but for the sake of clarity, only one is shown in the drawing. The array of cards on the rotor may, if desired, include index cards having projecting tabs bearing suitable letters, numbers or other characters for identification.

Figure 4:
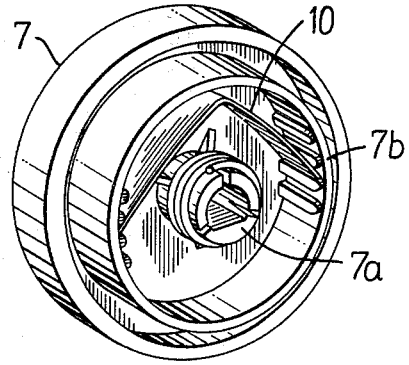
FIG. 4 is a perspective view showing the inside of the knob.
Figure 5:
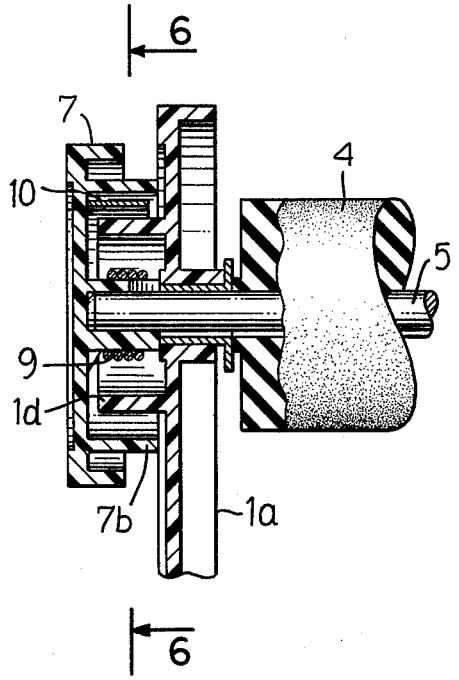
FIG. 5 is a partial sectional view taken approximately on the line 5—5 in FIG. 6.
Figure 6:
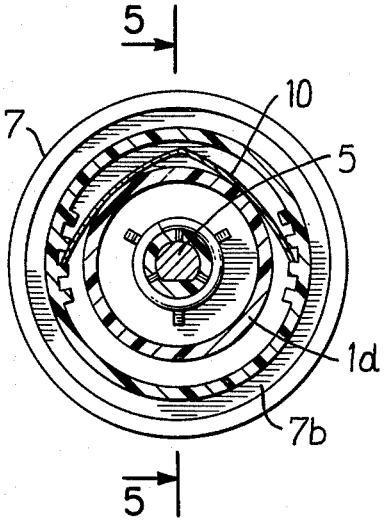
FIG. 6 is a cross section taken approximately on the line 6—6 in FIG. 5.

The rotor 4 is manually rotatable about a horizontal axis by means of knobs 7 and 8 fixed on opposite ends of the rotor shaft 5. As seen in FIGS. 4, 5 and 6 the knob 7 has an inwardly projecting hub portion 7*a* which fits tightly on an end of the rotor shaft 5. The shaft is preferably provided on one side with a flat surface engaging a corresponding flat surface in the hub 7*a* to assure that the shaft turns with the knob. Moreover, the hub is split longitudinally into three sectors and is embraced by a coil spring 9 which tends to constrict the hub and thereby retain it securely on the end of the shaft.

The knob 7 is further provided with an annular flange 7*b* which projects inwardly toward the side support 1*a* of the case. The flange 7*b* surrounds and is spaced radially from an annular boss 1*d* which projects outwardly from the side support 1*a*. The boss 1*d* in turn surrounds and is spaced radially from the hub 7*a* of the knob. The annular flange 7*b* and annular boss 1*d* are concentric with the axis of the shaft 5. The annular boss 1*d* is conveniently molded integrally with the case 1. Likewise, the knob 7 is conveniently molded of suitable plastic material with integral hub portion and annular flange.

In accordance with the present invention, spring means is provided between the annular flange 7*b* of the knob 7 and the annular boss 1*d* of the case frictionally to retain the knob 7 and thereby retain the rotor 4 in whatever position it has been turned by the user. As seen in FIGS. 4, 5 and 6, the spring means comprises a flat, leaf spring 10 which is inserted between the annular hub 1*d* and the annular flange 7*b* so that the ends of the spring bear on the inside of the flange 7*b* while intermediate portions of the spring frictionally engage the outer surface of the annular boss 1*d* of the case. The spring 10 is rotationally fixed with respect to the knob 7 by engagement of ends of the spring with abutments on the inner surface of the annular flange 7*b*. The abutments are shown in FIGS. 4 and 5 as inwardly projecting teeth on the flange 7*b*. The series of teeth can extend throughout the circumferential extent of the flange and have the advantage that the spring can be assembled in any desired position with respect to the knob. Moreover, the tension on the spring can be selected when the spring is being assembled in the knob according to the teeth that the ends of the spring engage. However, it is sufficient to provide a single abutment for each end of the spring.

In relaxed condition the spring 10 is V-shaped as seen in FIG. 4. When the knob 7 is assembled on the shaft of the rotor, the spring 10 is bowed outwardly by the annular boss 1*d* so that the spring by its resilience is pressed into frictionally engagement with the boss. Since the boss is stationary and since the spring 10 is rotationally fixed with respect to the knob 7, frictional engagement of the spring 10 with the boss 1*d* retains the knob 7 and hence the rotor 4 in the position to which it has been turned by the knobs 7 and 8.

The knob 8 can, if desired, be identical with the knob 7 and provided with a spring frictionally engaging an annular boss on the outer face of the side support 1*b*. Alternatively, a spring may be provided in only one of the knobs in which event the other knob need not have an inwardly projecting flange and the respective side support of the case need not have an outwardly projecting annular boss.

While a preferred embodiment has been shown by way of example in the drawings, it will be recognized that modifications can be made while still retaining the substance and advantages of the invention. Thus, while the spring 10 is shown as a flat leaf spring bent to a V shape, it can be of different cross section and of different shape. Moreover, the positions of the annular flange 7*b* and the annular boss 1*d* can be reversed so that the flange is radially inwardly of the boss. In this event the spring is preferably rotationally fixed with respect to the boss and bears frictionally on the flange of the knob. Still other modifications will occur to those skilled in the art.

What I claim and desire to secure by letters patent is:

1. A rotary card holder comprising a case having spaced upright supports with inner and outer faces, a rotor disposed between said supports and having means for holding a plurality of cards, said rotor having shaft portions extending axially from opposite ends of said rotor and rotatably supported by said supports to mount said rotor rotatably in said case, at least one of said shaft portions projecting beyond the outer face of the respective support, an annular boss on the outer face of said respective support surrounding said projecting shaft portion, a knob fixed on said projecting shaft portion for manually turning said rotor, said knob having an annular flange portion surrounding said boss, and spring means acting between said flange portion and said boss frictionally to resist rotation of said knob and rotor, whereby said rotor is frictionally retained in a position to which it has been manually turned by said knob, said spring means comprises a spring having end portions bearing on the inside of said flange portion and an intermediate portion bearing on said boss.

2. A rotary card holder according to claim 1, in which said spring is V-shaped, end portions of said V bearing on the inside of said flange portion and side portions of said V frictionally engaging said boss.

3. A rotary card holder according to claim 2, in which abutments on the inside of said flange portion engage end portions of said spring to retain said spring against movement circumferentially of said rim portion.

4. A rotary card holder according to claim 2, in which said spring is a leaf spring.

5. A rotary card holder according to claim 1, in which said knob has a split hub portion through which said shaft portion extends and in which coil spring means surrounds and tends to contract said hub portion to grip said shaft portion.

6. A rotary card holder comprising a case having spaced upright supports with inner and outer faces, a rotor disposed between said supports and having means for holding a plurality of cards, said rotor having shaft portions extending axially from opposite ends of said rotor and rotatably supported by said supports to mount said rotor rotatably in said case, said shaft portions projecting beyond the outer faces of said supports, a knob fixed on each of said projecting shaft portions for manually turning said rotor, an annular boss on the outer face of one of said supports surrounding the corresponding projecting shaft portion, the knob on said corresponding projecting shaft portion having an annular flange portion surrounding said boss, and spring means acting between said flange portion and said boss frictionally to resist rotation of said knob and rotor, whereby said rotor is frictionally retained in a position to which it has been manually turned by said knobs said spring means comprises a spring having end portions bearing on the inside of said flange portion and an intermediate portion bearing on said boss.

7. A rotary card holder according to claim 6, in which said spring is V-shaped.

8. A rotary card holder according to claim 7, in which said spring is a leaf spring.

* * * * *